United States Patent [19]

Ide et al.

[11] 4,194,900

[45] Mar. 25, 1980

[54] HARD ALLOYED POWDER AND METHOD OF MAKING THE SAME

[75] Inventors: Tsuneyuki Ide; Ken-ichi Takagi; Michio Watanabe; Seiichi Ohhira; Masahito Fukumori; Yoshikazu Kondo, all of Kudamatsu, Japan

[73] Assignee: Toyo Kohan Co., Ltd., Japan

[21] Appl. No.: 949,424

[22] Filed: Oct. 5, 1978

[51] Int. Cl.[2] ..... B22D 23/08

[52] U.S. Cl. ..... 75/0.5 C; 75/251; 75/254; 264/11; 264/12; 264/13; 264/14

[58] Field of Search ..... 75/0.5 BC, 0.5 C, 251, 75/254; 264/11, 12, 13, 14

[56] References Cited

U.S. PATENT DOCUMENTS

| | | | |
|---|---|---|---|
| 3,341,337 | 9/1967 | Quaas et al. | 75/254 |
| 3,556,780 | 1/1971 | Holtz, Jr. | 75/0.5 BC |
| 3,970,445 | 7/1976 | Gale et al. | 75/0.5 BC |
| 3,999,952 | 12/1976 | Kondo et al. | 75/202 |

*Primary Examiner*—W. Stallard

*Attorney, Agent, or Firm*—Wenderoth, Lind & Ponack

[57] ABSTRACT

There is provided a hard alloyed powder comprising:

B—from 3 to 20% by weight,

Al—less than 3% by weight,

Si—less than 5% by weight,

O—less than 2.5% by weight, at least one metal selected from the group consisting of Cr, Mo, W, Ti, V, Nb, Ta, Hf, Zr, Co and Ni, in the following amounts: Cr from 5 to 35% by weight, Mo from 1 to 35% by weight, W from 0.5 to 30% by weight and each of Ti, V, Nb, Ta, Hf, Zr, Co and Ni—less than 15% by weight, and the balance being at least 10% by weight of Fe.

A method for the production of said alloy powder is also provided and comprises atomizing molten alloy with water or inert gas in a specific manner.

4 Claims, 2 Drawing Figures

HARD ALLOYED POWDER AND METHOD OF MAKING THE SAME

BACKGROUND OF THE INVENTION

This invention relates to a hard alloyed powder of a multiple boride comprising iron in which a part of iron boride is substituted by a non-ferrous boride or multiple boride such as Cr, Mo, W, Ti, V, Nb, Ta, Hf, Zr, Co and Ni, and to a method of making such hard alloyed powder.

The cemented carbides, especially materials comprising tungsten carbide as a hard phase, have hardness and strength and they have been broadly used for metal cutting tools, metal molds and the like.

However, tungsten, a main element of cemented carbide, is becoming increasingly scarce and therefore the cost of this raw material is very high.

Further, the specific gravity of the cemented carbides are as high as 13 to 15.

Moreover, the cemented carbides are very poor both in corrosion resistance and oxidation resistance at high temperature.

On the other hand, the Stellite Co base alloy comprising W and Cr, has good corrosion resistance and high oxidation resistance, but is poor in hardness and wear resistance. In order to improve corrosion resistance, oxidation resistance at high temperature, high specific gravity, high cost of raw materials and so forth, we had proposed a sintered hard alloy, prepared from a hard alloyed powder comprising iron boride or iron multiple boride in which a part of iron boride is substituted by a non-ferrous boride or multiple boride. See for example U.S. Pat. No. 3,999,952.

Improved corrosion resistance, oxidation resistance at high temperature, low specific gravity and low cost of raw materials were attained but the sintered hard alloy of said patent did not have strength comparable to the cemented carbides.

This is mainly due to the nature of the hard alloyed powder which is main raw material of the sintered hard alloy.

We found that the inclusion useful boride-forming elements such as Cr, Mo, W, V, Nb, Ta, Ti, Zr, Hf, Co and Ni, in this hard alloyed powder, make the sintered hard alloy stronger and harder. In contrast, Al, oxygen and C in small amounts in the hard alloyed powder, make the hard alloyed powder brittle, with the result that the sintered alloy becomes poor in strength.

OBJECTS AND BRIEF SUMMARY OF THE INVENTION

It is a primary object of this invention to improve the strength of said sintered hard alloy so as to be comparable with that of the cemented carbides.

More specifically, the primary object of this invention is to provide hard alloyed powder, useful as a main raw material powder of said sintered hard alloy.

Still another object is to provide a method of making such hard alloyed powder.

According to the present invention, there is provided the hard alloyed powder which has improved strength.

The hard alloyed powder of this invention comprises:

B—3 to 20% by weight,

Al—less than 3% by weight,

Si—less than 5% by weight, oxygen—less than 2.5% by weight, at least one metal selected from the group consisting of Cr, Mo, W, Ti, V, Nb, Ta, Hf, Zr, Co and Ni and the balance being at least 10% by weight of Fe.

The present invention also provides a method of making such hard alloyed powder by atomization of the molten alloy with water or inert gas.

DETAILED DESCRIPTION OF THE INVENTION

Figure 1:
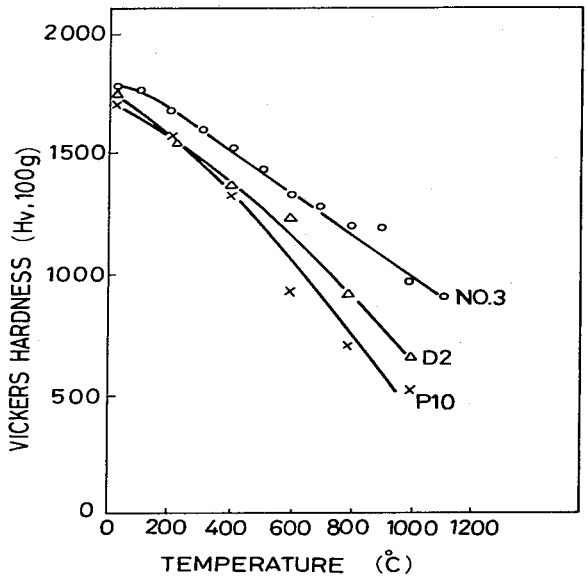
FIG. 1 is a graph illustrating the relationship between the temperature and Vickers hardness (100 g loaded) of samples.

The sintered hard alloy of the present invention is essentially composed of a boride or multiple boride as a hard phase and a metal or alloy as a binder phase.

This hard phase is composed of the boride in which Fe boride is partly replaced by at least one metal selected from the group consisting of Cr, Mo, W, Ti, V, Nb, Hf, Ta, Zr, Co and Ni.

The structure of the boride comprises the MB type (M indicates the metal element) and the $M_2B$ type, and the structure of the multiple boride is of the $M_XN_YB$ type (M and N indicate the metal elements).

B is a basic element of the hard alloyed powder of this invention which forms hard phase of boride and multiple boride as described in the foregoing.

The B content in hard alloyed powder is from 3 to 20% by weight, preferably from 5 to 16% by weight.

When the B content is from 3 to 12% by weight, this hard alloyed powder mainly consists of the $M_2B$ type boride and/or multiple boride. When the B content is from 12 to 20% by weight, this hard alloyed powder mainly consists of the MB type boride and/or multiple boride.

This sintered hard alloy also comprises a binder phase which combines with said hard phase, and makes said sintered hard alloy strong.

The binder phase is composed of at least one metal selected from Cr, Fe, Mo, W, Ti, V, Nb, Ta, Hf, Zr, Co, Ni and Cu, alloys of these metals, or alloys composed mainly of these metals.

When the B content is lower than 3% by weight, the hardness of the hard alloyed powder does not reach the desired high level. Accordingly, the lower limit of B content is 3% by weight, preferably 5% by weight.

In contrast, if the B content is too high, the hard alloyed powder becomes brittle, resulting in reduction of the transverse rupture strength, and it is difficult to obtain sufficient strength. Accordingly, in this invention, it is specified that the upper limit of B content is 20% by weight, preferably 16% by weight.

The content of Fe in the hard alloyed powder is at least 10% by weight. The Vickers hardness of Fe boride is about 1300 to 1700 for $Fe_2B$, and about 1800 to 2000 of FeB. As Fe is one of the lowest cost metals which makes a boride or multiple boride, Fe is preferably present as much as possible, in view of the wear resistance and the strength of the hard alloyed powder.

Cr forms a stable and hard boride, of which the Vickers hardness is about 1300 for $Cr_2B$ and about 1200 to 2000 for CrB. Cr boride also improves the corrosion resistance and oxidation resistance comparable to those of stainless steel or heat resistant steel, and its hardness is further enhanced and high hardness and high toughness can be maintained, even at high temperature. The preferable content of Cr is from 5 to 35% by weight. When the Cr content is lower than 5% by weight, the foregoing effect is poor. In contrast, when the Cr content is higher than 35% by weight, increases in effect due to Cr are little.

Mo and W make stable boride not only at room temperature but also at high temperature, moreover, the hardness of their borides is very high, for example, the hardness of $Mo_2B$ is about Hv 1660, that of MoB is about Hv 1750 to Hv 2350, that of $W_2B$ is about Hv 2420 and WB is about Hv 3750. When Mo and/or W are included in this hard alloyed powder, the resulting sintered hard alloy has good wear resistance.

Furthermore, when W is included in this hard alloyed powder, the sintered hard alloy becomes very hard, comparable with the cemented carbides. Then sintered hard alloy can be useful as a cutting tool of JIS SNCM-2 type steel.

When Cr, W and Mo are included in the hard alloy powder simultaneously, not only the cutting ability but also high corrosion resistance, high heat resistance and high oxidation resistance are much superior to those of the cemented carbide.

The Mo content in this hard alloyed powder of this invention is from 1 to 35% by weight, and preferably from 5 to 30% by weight.

When the Mo content is lower than 1% by weight, foregoing effect of Mo is not remarkable. In contrast, if Mo content is beyond 35% by weight, heat resistance and oxidation resistance become inferior.

The W content is from 0.5 to 30% by weight. If the W content is lower than 0.5% by weight, the foregoing effect of W is not remarkable. Since W is more expensive than Mo and the world W resources are now decreasing, increasing the W content in this hard alloyed powder makes it costly. Therefore the upper limit of W content is 30% by weight, preferably 20% by weight in view of the improvement of efficiency such as wear resistance, toughness and high cost.

When Co is included in this hard alloyed powder, it makes a stable boride and/or multiple boride, and therefore wear resistance will be improved. The Co content in the hard alloyed powder is less than 15% by weight.

When the Co content is too high, primary crystals grow very fast during the liquid sintering, and thus the strength of this sintered hard alloy becomes inferior. The influence of Ni is similar to that of Co, and the Ni content is less than 15% by weight.

Ti, V, Nb, Ta, Hf and Zr are metals of the Group IV-a or V-a of the Periodic Table, and all make stable borides and/or multiple borides when they are included in this hard alloyed powder.

For example hardness of TiB is about Hv 2700 to Hv 2800, and that of $VB_2$ is about Hv 2080 to Hv 2800. If suitable amounts of Ti, V, Nb, Ta, Hf and Zr are present in this hard alloyed powder, each preferably being employed in an amount of less than 15% by weight, the wear resistance and strength of the sintered hard alloy is improved not only at room temperature but also at high temperature.

In the sintered hard alloy, the binder phase is present in addition to the hard phase. Said hard alloyed powder is the raw material of the hard phase; in contrast the binder phase comprises at least one metal selected from Cu, Ni, Co, Fe, Cr, Mo, W, Ti, Zr, V, Nb, Ta and Hf, and/or alloys of these metals, and/or alloys composed mainly of these metals.

Cu or Cu alloy has a relatively low melting point and hence it hardly forms a boride of Cu. It is considered that Cu or Cu alloy is molten at the sintering temperature to form liquid phase which is effective for increasing the density of the resulting sintered hard alloy.

Binder phase constituent elements other than Cu, Co, Fe and Ni have generally melting points higher than that of iron boride.

However, it is considered that as the sintering temperature is elevated, the elements form a eutectic liquid phase with iron boride and hence, the liquid sintering is made possible. Consequently, the resulting hard alloy hardly contains pores and it attains a substantially full density of 100% and becomes sufficiently dense and compact.

Although the shrinkage of dimension by the liquid sintering is as high as 10 to 20%, uniform shrinkage can be accomplished without collapse of its shape by controlling the sintering temperature and the metal contents. This sintered hard alloy consists of both the hard phase and the binder phase.

It was found that the limiting of the amounts of Al, Si, oxygen and C in the hard alloyed powder are very important to give superior strength to the sintered hard alloy.

Al, which is present in this hard alloyed powder, seems to be combined with B and oxygen during the liquid sintering, which leads to a slowdown in the rate of liquid sintering.

Accordingly, uniform shrinkage or full density of 100% cannot be obtained, and strength of this sintered hard alloy deteriorates.

Al content in the hard alloyed powder is less than 3% by weight, preferably less than 1% by weight.

When C is present in the hard alloyed powder, C combines with oxygen during the liquid sintering, forming CO gas or $CO_2$ gas, then this CO or $CO_2$ gas forms micropores in the sintered hard alloy. Therefore the C content in this hard alloyed powder should be kept at less than 2% by weight, preferably less than 1% by weight.

Oxygen combines with Al, C and other metals which are contained in this hard alloyed powder such as Cr, Ti, V, Nb and so forth, becoming oxides.

Then these oxides make the sintered hard alloy brittle. Accordingly, the oxygen content in this hard alloyed powder must be kept at less than 2.5% by weight.

Si in the hard alloyed powder accelerates the rate of liquid sintering while Al slows down the rate of liquid sintering. It is believed that the wettability and fluidity of this sintered hard alloy during liquid sintering is improved when Si is present in this hard alloyed powder. When the Si content is less than 0.3% by weight, the effect of Si is little. In contrast, if Si content is more than 5% by weight, the sintered hard alloy becomes brittle. Accordingly, in this invention, it is specified that the range of Si content is less than 5% by weight, preferably from 0.3 to 5% by weight.

From the industrial viewpoint, it is most advantageous to produce this hard alloyed powder, according to the so-called water atomizing or gas atomizing method, comprising forming a molten alloy comprising Fe, ferro-boron and desired additive element metals, then letting the molten alloy fall from small holes and atomizing fine streams of the molten alloy by high pressure water jets or argon or nitrogen gas jets projected from nozzles.

Another reason for producing this hard alloyed powder by water atomization or gas atomization is that alloying elements, such as B, Cr, Mo, W, Ti and the like are uniformly distributed. At the same time, the microstructure of this hard alloyed powder exhibits a very fine grain size.

It is also possible to adopt a method comprising melting such alloy, solidifying the alloy to form a boride alloyed ingot and pulverizing it mechanically, or a method comprising mixing ferro-boron powder with boride powders of other elements. But only the sintered hard alloy which uses the hard alloyed powder produced by water or gas atomization, as the raw material, has the best strength and hardness.

In this invention, a process of forming the hard alloyed powder comprises the steps of preparing the raw material, comprising iron, ferroboron and desired additive elements. In the raw material, B is added in an amount of from 3 to 20% by weight, Si is up to 5% by weight and at least one metal selected from Cr, Mo, W, Ti, V, Nb, Ta, Hf, Zr, Co and Ni, and when these metals are desired to be added, Cr is from 5 to 35% by weight, Mo is from 3 to 35% by weight, W is from 0.5 to 30% by weight, each of Ti, V, Nb, Ta, Hf, Zr, Co and Ni is present up to 15% by weight and the balance is essentially at least 10% by weight of Fe.

In the next process, said raw material is melted in an atmosphere comprising $O_2$ less than 30% by volume, preferably from 5 to 30% by volume. It is believed that Al, being included in the raw material, is preferentially oxidized and rises to the surface of the molten alloy as slag. Then this molten alloy falls from small holes in the atmosphere of inert gas such as nitrogen, argon and like, not to be oxidized B and the desired elements during the water atomization or the gas atomization.

The molten alloy is formed into particles by a sheets or curtains of water or inert gas. The water or the inert gas is under a high pressure and impinges against the stream of the molten alloy to form particles or to atomize the stream. The water or the gas is directed against the stream of molten alloy at an angle of 10° to 20° from the vertical. The water which is used for the atomization is substantially at a pressure above 40 $Kg/cm^2$. There is no maximum pressure limit for the water and normally, the maximum pressure is based on the pumping equipment used.

Metal powder forming binder phase is mixed with the so prepared hard alloyed powder, and the mixture is ground or pulverized to fine particles by using a ball mill or a vibration ball mill. The obtained mixture is formed in a green compact having a desired shape by using a press or cold isostatic press. The green compact is sintered in vacuum or in hydrogen gas, argon or nitrogen gas, to thereby form a part of a liquid phase locally in the compact, whereby the density of the sintered body can be increased substantially to the full density of 100%.

In addition, it is possible to obtain a sintered body of a high density according to the hot isostatic press process, the hot press, alone or in combination with the liquid sintering process. The sintered hard alloy prepared by using this hard alloyed powder according to this invention has generally a Rockwell A scale hardness of 80 to 94 and a transverse rupture strength of 50 to 280 $Kg/mm^2$, as measured according to the test method of JIS H5501 on tips of the cemented carbides alloy.

The sintered hard alloy prepared by using this hard alloyed powder according to this invention can be applied in uses where high speed steels and the cemented carbides alloys have heretofore been employed. More specifically, this sintered hard alloy can be used for production of tools, dies or punches for drawing, ironing or swaging metals which are used at room temperature and at elevated temperatures, metal molds for cold or hot working, cutting tools and heat resistant alloy articles used at high temperatures. Still further, it can be applied to uses where a high rust resistance, a high oxidation resistance, a high hardness and a high wear resistance are required.

More specially, the hard alloyed powder of this invention can be used for production of composite metal materials by laminating it on other metal substrates or spray coating it on metal substrates. Moreover, the hard alloyed powder of this invention can be used for production of composite metal materials, which comprises this hard alloyed powder as a dispersed hard particle and the matrix phase being composed of metal or self-fluxing alloy. For example, a process for the production of this dispersed composite material is by the powder metallurgy, of which this hard alloyed powder and matrix metal or alloyed powder are mixed, then being filled in a mold, and being heated until this matrix powder is fused. In the process of heating, the matrix powder is fused and surrounds the hard alloyed powder.

In order to segregate the hard alloyed powder in this dispersed composite material, this mold is rotated at high speed during the process of heating, making use of the difference in specific gravity between the hard alloyed powder and the matrix powder. This dispersed composite material prepared according to this invention can be applied to uses where high resistance and a high hardness are required. When this hard alloyed powder is used for this dispersed composite material or spray coating, it is very important that the content of Al, oxygen, C and Si, included in the hard alloyed powder, have a great influence on its properties such as toughness and hardness.

This invention will now be described in detail with reference to the following Examples, which Examples by no means limit the scope of this invention.

EXAMPLE 1

Raw materials for the hard alloyed powder having the following composition in weight percent were supplied to a high frequency induction furnace.

Ferro-boron . . . B 20.0%, Al 1.5–7.3%, Si 0.9–1.4%
Electrolytic chromium metal . . . Cr 99.8%, Al 0.004%, Si 0.003%
Tungsten metal . . . W 99.84%, C 0.01%, Si 0.003%
Molybdenum metal . . . Mo 99.93%, C 0.01%, Al 0.004%
Ferro vanadium . . . V 83.53%, C 0.12%, Si 1.15%, Al 1.5%, Fe balance
Electrolytic Iron . . . C 0.001%, Si 0.002%, Fe balance
Silicon metal . . . Si 98.49%, Al 0.26%, C 0.03%

These materials are melted to form a molten alloy, and the atmosphere of the furnace is argon gas being mixed with 20% by volume of $O_2$. Then molten alloy was supplied to a tundish, and molten alloy flowed downwardly by gravity through an outlet nozzle having an internal diameter of 12 mm. Two oppositely directed streams of water, positioned at a downward angle of 15° with respect to the axis of the molten alloy stream, were impinged against the alloy to atomize the molten alloy. The water was under a pressure of 70 $Kg/cm^2$, and the atmosphere below the outlet nozzle was nitrogen gas.

The resulting atomized hard alloy powder had the following chemical analysis in weight percent.

Boron . . . 8.4%
Chromium . . . 8.8%
Molybdenum . . . 5.0%
Tungsten . . . 14.8%
Vanadium . . . 1.5%
Aluminum . . . 0.00%
Silicon . . . 0.77%
Oxygen . . . 0.28%
Carbon . . . 0.08%
Manganese . . . 0.10%
Iron . . . balance This is an $M_2B$ type hard alloyed powder.

Then, another hard alloyed powder of MB type was atomized by the foregoing method, having the following chemical analysis in weight percent.

Boron . . . 15.0%
Chromium . . . 5.6%
Tungsten . . . 14.0%
Vanadium . . . 1.52%
Aluminum . . . 0.27%
Silicon . . . 1.87%
Oxygen . . . 0.33%
Carbon . . . 0.09%
Manganese . . . 0.11%
Iron . . . balance The thus obtained powders were mixed with Mo powder, Ni powder and 60% Cr—20% V—balance Fe alloy powder. The mixing ratio is as follows in weight percent:

MB type hard alloyed powder . . . 40%
$M_2B$ type hard alloyed powder . . . 10%
Mo powder . . . 44%
Ni powder . . . 1%
60% Cr—20% V—balance Fe alloy powder . . . 5%

And the mixture was wet-milled for 168 hours by means of a ball mill using an ethyl alcohol solution and then was dried in a nitrogen gas atmosphere.

The dried particulate mixture was compact-formed into a metal mold into a size of 5.2 mm×10.4 mm×32 mm under a molding pressure of 1.5 $ton/cm^2$. (In the subsequent Examples, green compacts had the same size as mentioned above, unless otherwise indicated.) The green compact was liquid sintered at 1200° C. in a vacuum of $10^{-3}$ mmHg for 30 minutes.

A compact sintered hard alloy having a transverse rupture strength of 190 $Kg/mm^2$, a Rockwell A scale hardness ($H_RA$) of 90.2 and a specific gravity of 7.96 $g/cm^3$ was obtained.

EXAMPLE 2

Two kinds of MB type hard alloyed powder, using ferro boron, Electrolytic chromium metal, Tungsten metal and so forth as raw materials, were atomized by the same method described in Example 1. The resulting atomized MB type hard alloyed powder had the following chemical analysis in weight percent:

Boron . . . 14.3%
Chromium . . . 5.6%
Tungsten . . . 14.0%
Aluminum . . . 0.25%
Silicon . . . 1.71%
Oxygen . . . 0.30%
Manganese . . . 0.12%
Carbon . . . 0.08%
Iron . . . balance Another atomized MB type hard alloyed powder had the following analysis in weight percent.

Boron . . . 14.0%
Chromium . . . 7.8%
Vanadium . . . 3.8%
Aluminum . . . 0.22%
Silicon . . . 1.30%
Oxygen . . . 0.32%
Carbon . . . 0.10%
Manganese . . . 0.09%
Iron . . . balance Thus obtained powders were mixed with Mo powder, Ni powder and $M_2B$ type hard alloyed powder of Example 1.

The mixing ratio is shown as follows in weight percent:

MB type powder of 14.3% B—5.6% Cr—14.0% W alloy . . . 15%
MB type powder of 14.0% B—7.8% Cr—3.8% V alloy . . . 10%
$M_2B$ type powder of 8.4% B—8.8% Cr—5.0% Mo—14.8% W—1.5% V alloy . . . 30%
Mo powder . . . 44%
Ni powder . . . 1%

The mixture was wet milled for 168 hours by means of a ball mill, dried in nitrogen gas and the compact was formed under a molding pressure of 1.5 $ton/cm^2$.

The resulting green compact was sintered in a vacuum at 1225° C. for 30 minutes to obtain a sintered hard alloy having a transverse rupture strength of 198 $Kg/mm^2$, a Rockwell A scale hardness ($H_RA$) of 89.5 and specific gravity of 8.10 $g/cm^3$.

EXAMPLE 3

MB type and $M_2B$ type hard alloyed powder were atomized by the same method described in Example 1. The resulting atomized MB type hard alloyed powder had the following chemical analysis in weight percent.

Boron . . . 16.4%
Chromium . . . 11.0%
Aluminum . . . 0.30%
Silicon . . . 1.36%
Oxygen . . . 0.45%
Carbon . . . 0.07%
Manganese . . . 0.10%
Iron . . . balance And the $M_2B$ type hard alloyed powder had the following chemical analysis in weight percent.

Boron . . . 9.0%
Chromium . . . 12.5%
Aluminum . . . 0.27%
Silicon . . . 0.95%
Oxygen . . . 0.31%
Carbon . . . 0.11%
Manganese . . . 0.09%
Iron . . . balance The obtained powders were mixed with Cr powder, Mo powder and Ni powder. The mixing ratio is shown as follows in weight percent:

MB type hard alloywed powder . . . 43%
$M_2B$ type hard alloyed powder . . . 16%
Cr powder . . . 15%
Mo powder . . . 25%

Ni powder . . . 1%

And the mixture was wet milled for 168 hours by means of a ball mill, dried in nitrogen gas and the compact was formed under a molding pressure of 1.5 ton/cm$^2$.

The compact was sintered in vacuum at 1200° C. for 30 minutes to obtain a sintered hard alloy having a transverse rupture strength of 126 Kg/mm$^2$ and a Rockwell A scale hardness ($H_RA$) of 91.1.

This sintered hard alloy was measured for hardness at high temperature, as shown in FIG. 1.

It was a Vickers hardness (100 g loaded), being measured in a vacuum, at the same time, that of the cemented carbide D-2 (WC—7% Co) and the cemented carbide P-10 (63% WC—9% Co—28% TiC) were measured.

EXAMPLE 4

An MB type hard alloyed powder was prepared by the same method described in Example 1. The resulting atomized MB type hard alloyed powder had the following chemical analysis in weight percent.

Boron . . . 14.0%
Chromium . . . 10.0%
Tungsten . . . 6.0%
Aluminum . . . 0.35%
Silicon . . . 1.72%
Oxygen . . . 0.31%
Carbon . . . 0.10%
Manganese . . . 0.08%
Iron . . . balance This hard alloyed powder was mixed with Cr powder and Mo powder. The mixing ratio is shown as follows in weight percent:

MB type hard alloyed powder . . . 55%
Cr powder . . . 22.5%
Mo powder . . . 22.5%

And the mixture was wet milled for 168 hours by means of a ball mill, dried in nitrogen gas and compact formed under a molding pressure of 1.5 ton/cm$^2$. The compact was sintered in vacuum at 1225° C. for 30 minutes to obtain a sintered hard alloy having a transverse rupture strength of 122 Kg/mm$^2$ and a Rockwell A scale hardness ($H_RA$) of 91.0.

This sintered hard alloy was measured for rust resistance at high temperature in an air atmosphere.

The cemented carbide D-2, the heat resisting steel SUH-3 (C 0.4%, Cr 11%, Mo 0.1%, Si 2.2%, Fe balance) and the Stellite No. 1 (C 2%, Cr 30%, W 12%, Co balance) were measured as comparative examples.

The testing method is that the weight increase by oxidation is observed after these sample are heated at 1000° C. in air.

Figure 2:
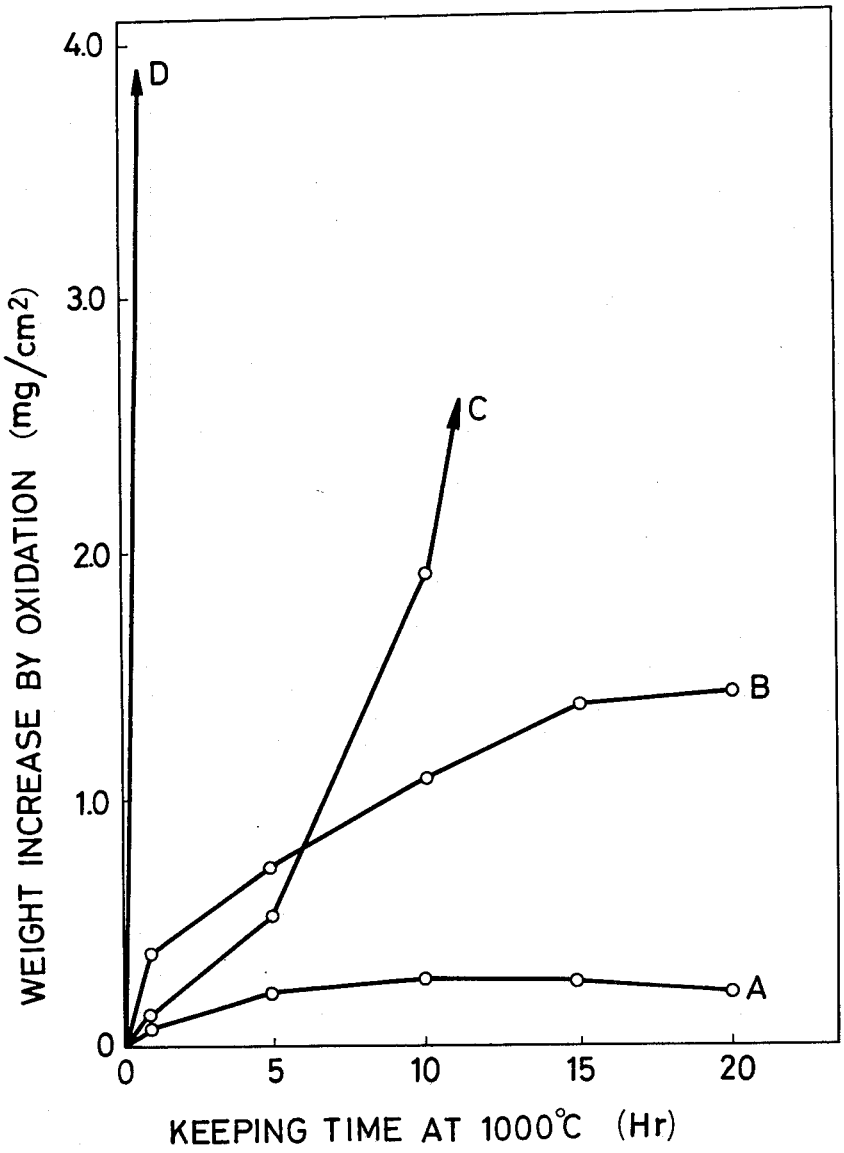
FIG. 2 is a graph illustrating the relationship between the weight increase by oxidation and the sample which is kept at 1000° C. in air.

As is shown in FIG. 2, this sintered hard alloy shows a little weight increase by oxidation.

In FIG. 1, No. 3 is the sample of Example 3, D2 is D-2 type cemented carbide having chemical analysis of WC—7% Co, P10 is P-10 type cemented carbide having chemical analysis of 63% WC—9% Co—28% TiC.

The sample of Example 3 retains the highest hardness at high temperature.

In FIG. 2, "A" is the sample of Example 4, "B" is the Stellite No. 1 having chemical analysis of 2% C—30% Cr—12% W—Co balance, "C" is the heat resisting steel of SUH-3 type having chemical analysis of 0.4% C—11% Cr—0.1% Mo—2.2% Si—balance Fe, and "D" is D-2 type cemented carbide having chemical analysis of WC—7% Co.

What is claimed is:

1. Hard alloy powder comprising:
B—from 3 to 20% by weight,
Al—less than 3% by weight,
Si—from 0.3 to 5% by weight,
O—less than 2.5% by weight,
at least one metal selected from the group consisting of Cr, Mo, W, Ti, V, Nb, Ta, Hf, Zr, Co and Ni, in the following amounts: Cr from 5 to 35% by weight, Mo from 1 to 35% by weight, W from 0.5 to 30% by weight and each of Ti, V, Nb, Ta, Hf, Zr, Co and Ni less than 15% by weight, and
the balance being at least 10% by weight of Fe.

2. Hard alloyed powder as claimed in claim 1, comprising from 5 to 35% by weight of Cr to improve the corrosion resistance and oxidation resistance of the powder.

3. A method of forming a hard alloyed powder by using a water atomizing or inert gas atomizing process, comprising the steps of:

a. preparing as a raw material a mixture of:
B—3 to 20% by weight, Si—up to 5% by weight,
at least one metal selected from Cr, Mo, W, Ti, V, Nb, Ta, Hf, Zr, Co and Ni in the following amounts: Cr—5 to 35% by weight, Mo—1 to 35% by weight, W—0.5 to 30% by weight, and each of Ti, V, Nb, Ta, Hf, Zr, Co and Ni—up to 15% by weight, and
the balance being at least 10% by weight of Fe, b. melting said raw material to form a molten alloy in an atmosphere comprising less than 30% by volume of oxygen, c. discharging a stream of said molten alloy in an atmosphere of an inert gas, d. impinging water or inert gas under pressure against said molten alloy stream at an angle from 10° to 20° with respect to the longitudinal axis of said stream to atomize the stream of said molten alloy.

4. A process as claimed in claim 3, wherein the pressure range of the water jet is above 40 Kg/cm$^2$.

* * * * *